US008028748B2

(12) United States Patent
Laitolais, Jr. et al.

(10) Patent No.: US 8,028,748 B2
(45) Date of Patent: Oct. 4, 2011

(54) TUBULAR CONTROL APPARATUS

(75) Inventors: Burney J. Laitolais, Jr., Lafayette, LA (US); David Stokes, Aberdeenshire (GB); Dougal Hugo Brown, Inverness (GB); Jean P. Buytaert, Mineral Wells, TX (US)

(73) Assignee: Frank's International, Inc., Houston, TX (US)

( * ) Notice: Subject to any disclaimer, the term of this patent is extended or adjusted under 35 U.S.C. 154(b) by 248 days.

(21) Appl. No.: 12/272,419

(22) Filed: Nov. 17, 2008

(65) Prior Publication Data

US 2009/0126941 A1 May 21, 2009

(30) Foreign Application Priority Data

Nov. 16, 2007 (GB) ..... 0722531.1

(51) Int. Cl.
*E21B 19/24* (2006.01)

(52) U.S. Cl. .... 166/77.51; 166/85.5; 175/85; 414/22.58

(58) Field of Classification Search ..... 166/77.1, 166/77.51, 85.1, 85.5; 414/22.57, 22.58, 414/22.71, 22.68

See application file for complete search history.

(56) References Cited

U.S. PATENT DOCUMENTS

| | | | | |
|---|---|---|---|---|
| 3,533,516 | A | 10/1970 | Guier | |
| 3,929,235 | A * | 12/1975 | Howard et al. | 414/22.67 |
| 4,610,315 | A * | 9/1986 | Koga et al. | 175/85 |
| 5,595,248 | A * | 1/1997 | Denny | 166/379 |
| 2005/0135902 | A1 | 6/2005 | Spisak | |
| 2005/0217863 | A1 * | 10/2005 | Drzewiecki | 166/381 |

FOREIGN PATENT DOCUMENTS

GB 2425816 11/2006

OTHER PUBLICATIONS

Schoenbeck Plant and Machine Techniques, "Elite Vacuum Pipe Lifter" (4 pages).
International Search Report and Written Opinion dated Mar. 17, 2009 (12 pages).
International Search Report and Written Opinion in Application No. PCT/US2008/083791, dated May 27, 2010 (7 pages).

* cited by examiner

*Primary Examiner* — Kenneth L Thompson
(74) *Attorney, Agent, or Firm* — Osha • Liang LLP

(57) ABSTRACT

A control apparatus to receive a tubular member includes a contact member configured to engage the tubular member, and a control mechanism operably coupled to the contact member, wherein the control mechanism is configured to dampen movement of at least one of the tubular member and the contact member as the tubular member engages the contact member.

9 Claims, 17 Drawing Sheets

TUBULAR CONTROL APPARATUS

CROSS-REFERENCE TO RELATED APPLICATIONS

The present application claims priority to United Kingdom Patent Application Serial No. 0722531.1, filed on Nov. 16, 2007, and entitled "Control Apparatus." The aforementioned priority application is hereby incorporated by reference in its entirety into the present application.

BACKGROUND OF DISCLOSURE

1. Field of the Disclosure

Embodiments disclosed herein generally relate to methods and apparatus to support and/or move an end of a tubular member. More specifically, embodiments disclosed herein relate to apparatus that are used to support a tubular member during assembly, such as oilfield tubular members that are disposed downhole.

2. Background Art

In oilfield exploration and production operations, various oilfield tubulars are used to perform important tasks, including, but not limited to, drilling the wellbore and casing the drilled wellbore. For example, a long assembly of drill pipes, known in the industry as a drill string, may be used to rotate a drill bit at a distal end to create the wellbore. Furthermore, after a wellbore has been created, a casing string may be disposed downhole into the wellbore and cemented in place to stabilize, reinforce, or isolate (among other functions) portions of the wellbore. As such, strings of drill pipe and casing may be connected together, end-to-end by threaded connections, where a female "pin" member of a first tubular is configured to threadably engage a corresponding male "box" member of a second tubular. Alternatively, a casing string may be made-up of a series of male-male ended casing joints coupled together by female-female couplers. The process by which the threaded connections are screwed together is called "making-up" a threaded joint and the process by which the connections are disassembled is referred to "breaking-out" the threaded joint. As would be understood by one having ordinary skill, individual pieces (or "joints") of oilfield tubulars come in a variety of weights, diameters, configurations, and lengths.

Referring to FIG. 1, a perspective view is shown of a drilling rig 101 used to run tubular members 111 (e.g., casing, drill pipe, etc.) downhole into a wellbore. As shown, drilling rig 101 includes a frame structure known as a "derrick" 102 from which a traveling block 103 and an elevator 105 and/or a top drive (not shown) may be used to manipulate (e.g., raise, lower, rotate, hold, etc.) tubular members 111. As shown, traveling block 103 is a device that is located at or near the top of derrick 102, in which traveling block 103 may move up-and-down (i.e., vertically as depicted) to raise or lower tubular members 111. As shown, traveling block may be a simple "pulley-style" block and may have a hook 104 from which objects below (e.g., elevator 105) may be hung. Additionally, elevator 105 may also be coupled below traveling block 103 and/or a top drive (not shown) to selectively grab or release tubular members 111 as they are to be raised or lowered within and from derrick 102. Typically, elevator 105 includes movable gripping components (e.g., slips) movable between an open position and a closed position (shown in FIG. 1). In the closed position, the movable components form a load bearing ring (or shoulder) about or upon which tubular members 111 may bear and be lifted. In the open position, the movable components of elevator 105 may move away from one another to allow the tubular members 111 to be brought within or removed from elevator 105.

When assembling a string of tubular members 111 together, the tubular members 111 may be removed from a pipe rack 112 and pulled towards an access opening 121, for example, a v-door, within the derrick 102 of the drilling rig 101. The tubular members 111 may be loaded onto a pipe ramp 125 adjacent to the access opening 121, in which a rigidly mounted end stop 131 may abut the ends of the tubular members 111 to support the tubular members 111 up against access opening 121. An elevator, for example 105 in FIG. 1, or other lifting device (e.g., cable and/or winch) may then grasp an end of a tubular member 111 located within access opening 121 and may then raise the tubular member 111 up in derrick 102 so that it may be threadably connected to the remainder of a downhole string 115 of tubular members 111. The reverse process, or one substantially similar thereto, may be used, such as when removing tubular members from the drilling rig 101.

However, when raised into derrick 102, tubular members 111 are usually suspended by their upper (proximal) end, and therefore may swing and have a significant amount of movement as received within derrick 102, particularly at their lower (distal) end. Further, tubular members 111 typically are about 40 ft (12 m) in length and 66 lbs/ft (98 kg/m) in weight. As such, tubular members 111 may be cumbersome and/or difficult to handle because of their size, weight, and length, particularly when manually manipulating tubular members 111. Furthermore, the process of manually handling tubular members 111 consumes time, slowing production and therefore increasing drilling rig costs. Accordingly, there exists a need to increase the ability of controlling tubular members 111 when being disposed within a drilling rig, as may be common within the oilfield industry.

SUMMARY OF INVENTION

In a first aspect, embodiments disclosed herein relate to a control apparatus to receive a tubular member including a contact member configured to engage the tubular member, and a control mechanism operably coupled to the contact member, wherein the control mechanism is configured to dampen movement of at least one of the tubular member and the contact member as the tubular member engages the contact member.

In another aspect, embodiments disclosed herein relate to a control apparatus to receive a tubular member including a contact member adapted to receive an end of the tubular member, and a control mechanism coupled to the contact member and configured to dampen movement of the tubular member received in the contact member.

In another aspect, embodiments disclosed herein relate to a control apparatus to receive a tubular member including a control mechanism operably coupled to a contact member configured to engage the tubular member, the control mechanism configured to dampen movement of at least one of the contact member and the tubular member as the tubular member engages the contact member.

In another aspect, embodiments disclosed herein relate to a control apparatus to receive a tubular member including a control mechanism operably coupled to a contact member adapted to receive the tubular member, wherein the control mechanism is configured to dissipate kinetic energy from the tubular member as received by the contact member.

In another aspect, embodiments disclosed herein relate to a method to make-up a first tubular member with a second tubular member including securing the first tubular member with a drilling rig, positioning the second tubular member adjacent to the drilling rig, raising the second tubular member with an elevator, dampening a movement of the second tubular member with a control apparatus, positioning the second tubular member above the first tubular member, and making-up a threaded connection between the first and second tubular members.

In another aspect, embodiments disclosed herein relate to a control apparatus to receive a tubular member including a contact member adapted to receive an end of the tubular member, and a control mechanism coupled to the contact member, wherein the control mechanism is configured to dampen movement of the tubular member received in the contact member, and wherein the control mechanism is configured to align an axis of the tubular member received in the contact member with an axis of another tubular member.

In another aspect, embodiments disclosed herein relate to a method to break-out a first tubular member with a second tubular member including breaking-out a threaded connection between the first and second tubular members, positioning the second tubular member adjacent a downhole opening on a drilling rig, receiving the second tubular member with a control apparatus, positioning the second tubular member adjacent an access opening of the drilling rig, and releasing the second tubular member with the control apparatus.

In another aspect, embodiments disclosed herein relate to a method to position a tubular member within a drilling rig including positioning the tubular member adjacent to the drilling rig, grasping the tubular member with an elevator, receiving the tubular member with a control apparatus, and moving the tubular member from a first position to a second position within the drilling rig.

Other aspects and advantages of the invention will be apparent from the following description and the appended claims.

DETAILED DESCRIPTION

Figure 1:
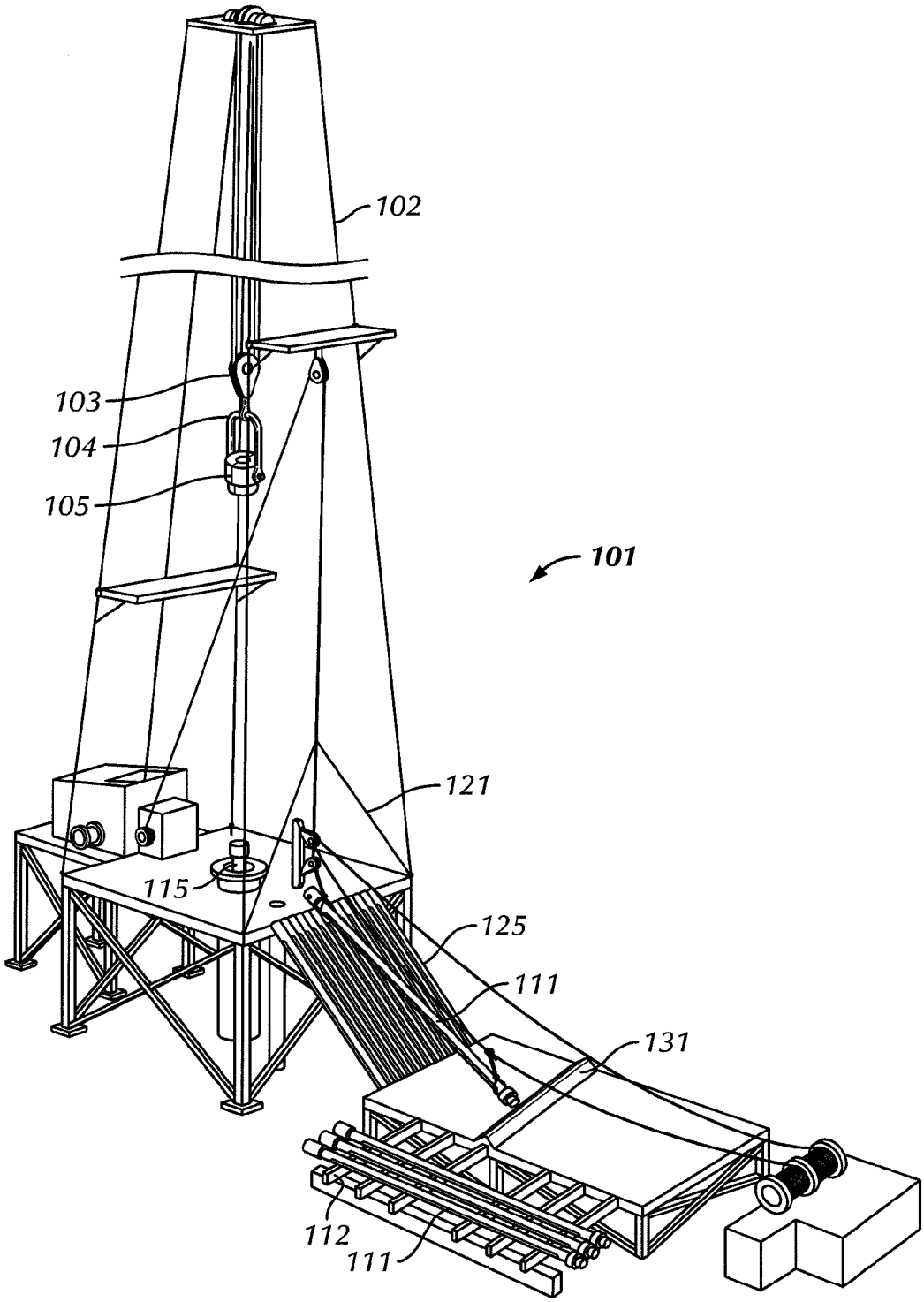
FIG. 1 is a schematic view of a drilling rig.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description.

In one aspect, embodiments disclosed herein generally relate to a control apparatus used to receive a tubular member. The control apparatus may include a contact member and a control mechanism. The contact member and the control mechanism may be operably coupled to each other, such as by having the control mechanism operate and/or control functions of the contact member. The contact member may be configured to receive the tubular member, such as when the tubular member enters a derrick through an access opening, in which the tubular member will contact and be received by the contact member. The control mechanism then supports the contact member when receiving the tubular member. Further, the control mechanism may alternatively or additionally dampen movement of the tubular member and/or the contact member as the tubular member is received by the contact member. As such, the control mechanism may dissipate kinetic energy, either immediately (i.e., a sudden stop) or in a dampened fashion (e.g., a slowed dissipation or "rate change" dissipation of kinetic energy), from the tubular member and/or the contact member as the tubular member and the contact member contact and/or engage each other.

In various embodiments disclosed herein, the contact member may be a flexible "tether" member, (e.g., a wire, cable or rope, etc.) and/or the contact member may be rigid, such as by having a rigid arm. The control mechanism may be electrically actuated, hydraulically actuated, pneumatically actuated, mechanically actuated, or the like, such as having piston cylinders used within the control mechanism. Similarly, the control mechanism or the contact member may be electrically, mechanically, hydraulically, or pneumatically dampened. The control apparatus, or at least a portion thereof, may be disposed adjacent to an access opening of a drilling rig, in which the tubular member entering the drilling rig may be received by the control apparatus. Further, the control apparatus may be configured to transport, or at least assist in the transport of a tubular member from the access opening to a downhole opening of the drilling rig. After being received by the contact member of the control apparatus, the tubular member may be connected to another tubular member within the drilling rig and disposed within the downhole opening. Further, in the various embodiments discussed below, the control mechanism may comprise a track and/or be flush with the drilling rig floor.

Referring now to FIGS. 2A-2D, multiple perspective view of a control apparatus 201 in accordance with embodiments disclosed herein are shown. Specifically, FIGS. 2A-2D show a perspective view as a tubular member 295 is received within and controlled by control apparatus 201. Control apparatus 201 includes a contact member 211 and a control mechanism 221, in which control mechanism 221 may be operably coupled to contact member 211. As such, control mechanism 221 may assist and/or control movement of contact member 211 (discussed more below). In FIGS. 2A-2D, control apparatus 201 may be disposed upon a drilling rig 291. Specifically, as shown, control apparatus 201 may be disposed adjacent an access opening 293 (e.g., a V-door) of drilling rig 291, in which a tubular member 295 may be delivered to drilling rig 291 through access opening 293. In this embodiment, contact member 211 of control apparatus 201 may be disposed across access opening 293 of drilling rig 291, such as by having contact member 211 disposed across a frame 213. Frame 213 may be attached to or disposed upon drilling rig 291, such as by having frame 213 integrally included or removably attached to the floor of drilling rig 291. As shown, frame 213 may include two frame members 231A and 213B, but one having ordinary skill in the art will appreciate that the present disclosure is not so limited. In other embodiments, the frame may have more than two members, or may only have one member.

As shown in FIGS. 2A-2D, control apparatus 201 may be configured to receive tubular member 295, such as to assist and control the movement of tubular member 295 as received within drilling rig 291. For example, when positioning tubular member 295 within drilling rig 291, tubular member 295 may be secured by an elevator (not shown here), such as at an upper end of tubular member 295, and then moved into drilling rig 291. As tubular member 295 enters drilling rig 291, such as through access opening 293, tubular member 295 may contact contact member 211 of control apparatus 201. As tubular member 295 contacts contact member 211, tubular member 295 may apply a force and/or load against contact member 211 from movement thereof. Particularly, the weight and the momentum of tubular member 295 may apply a force and load against contact member 211 as contact member 211 contacts and receives tubular member 295.

Because contact member 211 and control mechanism 221 are operably coupled to each other, the force and/or load received by contact member 211 may be translated, at least partially, to control mechanism 221. In select embodiments, control mechanism 221 may be configured to dampen the movement of contact member 211 and/or the tubular member 295 as tubular member 295 is received by and contacts contact member 211. For example, the energy from the movement of tubular member 295, or at least a portion thereof, may be translated to contact member 211. This energy of contact member 211, or at least a portion thereof, may then be translated to control mechanism 221. As such, the movement of tubular member 295 may be decreased as being received by contact member 211.

In FIGS. 2A-2D, control mechanism 221 enables contact member 211 to displace (e.g., slacken) as tubular member 295 is received within drilling rig 291 and contacts contact member 211. In this embodiment, contact member 211 may be flexible, or at least a portion thereof may be flexible, such as to allow contact member to displace in FIGS. 2A-2D. Therefore, contact member 211 may include a wire, a cable, a rope, a line, a lead, and/or a chain as a tether member. However, it should be understood that the present disclosure contemplates other structures for the contact member, such as by having a rigid contact member (discussed more below). Further, contact member 211 may be formed from or have a dampening and/or protective material disposed thereon, or at least partially thereon. A dampening material, such as a foam material and/or an elastic material, may be additionally or alternatively dampen at least a portion of the movement and/or energy translated to contact member 211. A protective material, such as a plastic material, may be able to help protect contact member 211 and/or tubular member 295 during contact.

As contact member 211 is displaced, control mechanism 221 may be actuated to control the displacement and movement of contact member 211. Control mechanism 221 may be pneumatically actuated, hydraulically actuated, electrically actuated, mechanically actuated, or the like, to control contact member 211. For example, in an embodiment in which control mechanism 221 is pneumatically actuated, contact member 211 may be operably connected to a cylinder and piston assembly of control mechanism 221. As contact member 211 then is displaced and moved by tubular member 295, this displacement and movement may be translated to the cylinder and piston assembly within control mechanism 221, in which the cylinder and piston assembly dampen the movement of tubular member 295 as received by contact member 211 (discussed more below).

Figure 2A:
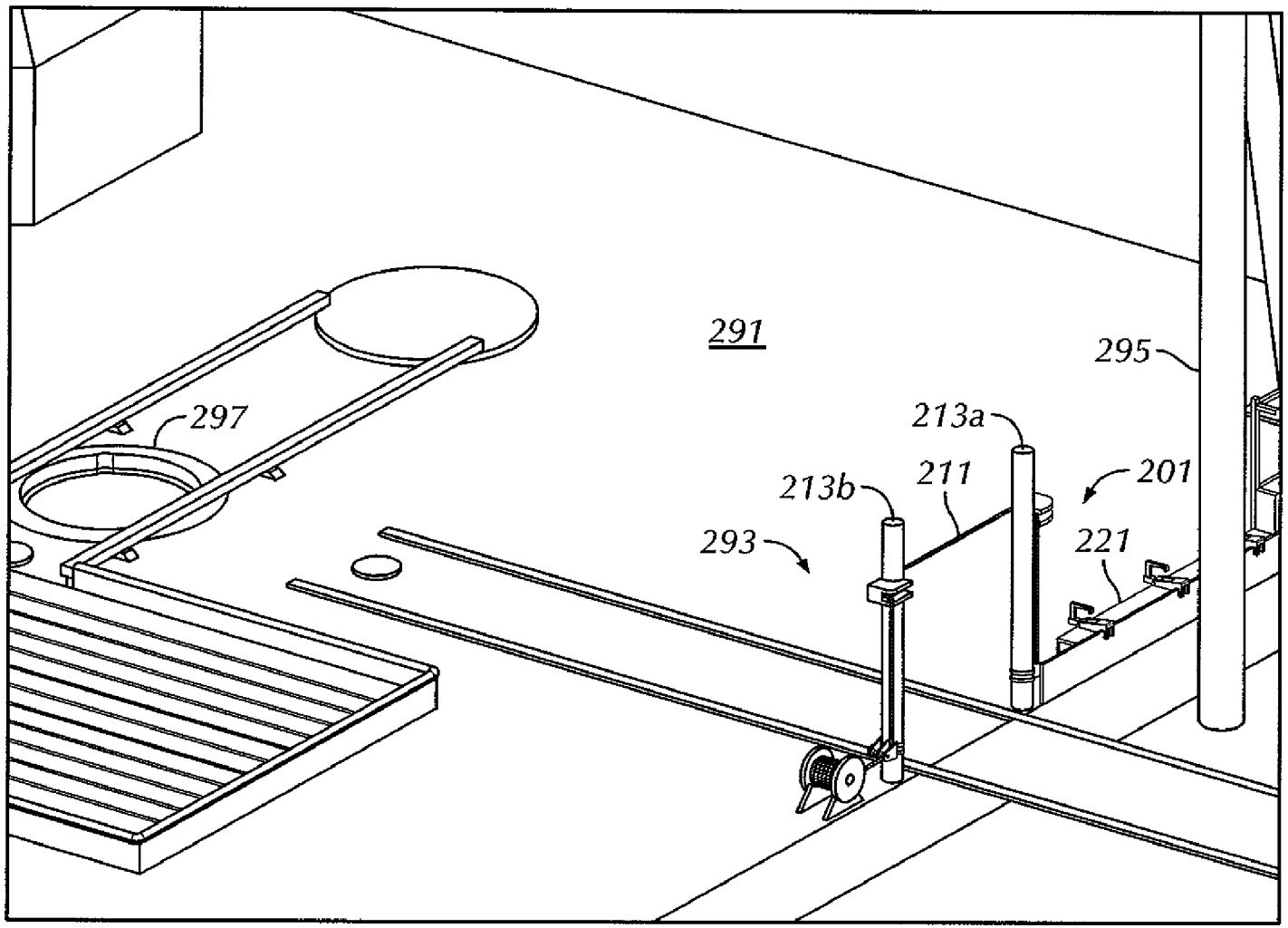
FIGS. 2A-2D show multiple views of a control apparatus in accordance with an embodiment of the present disclosure.
Figure 2B:
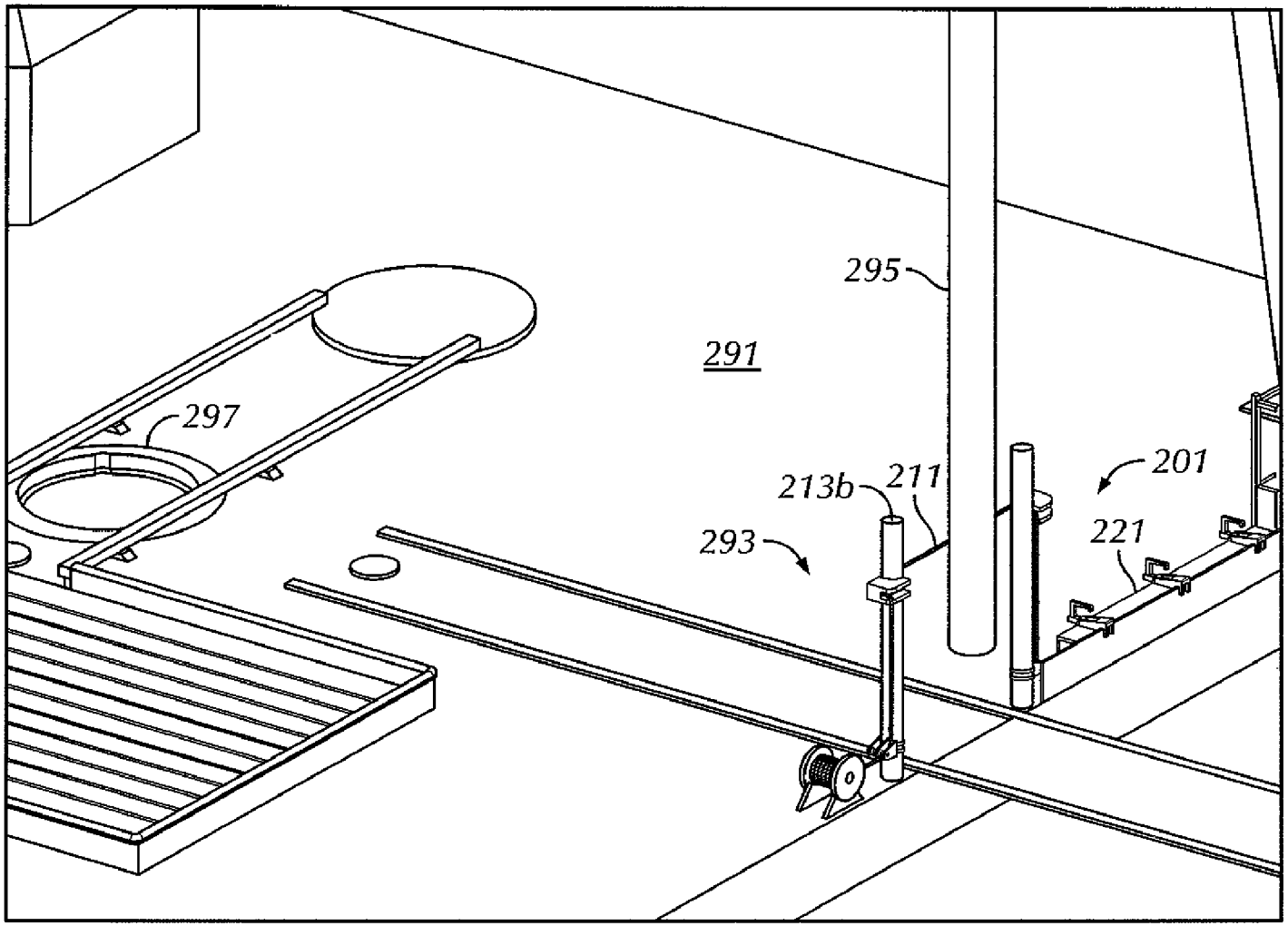
Figure 2C:
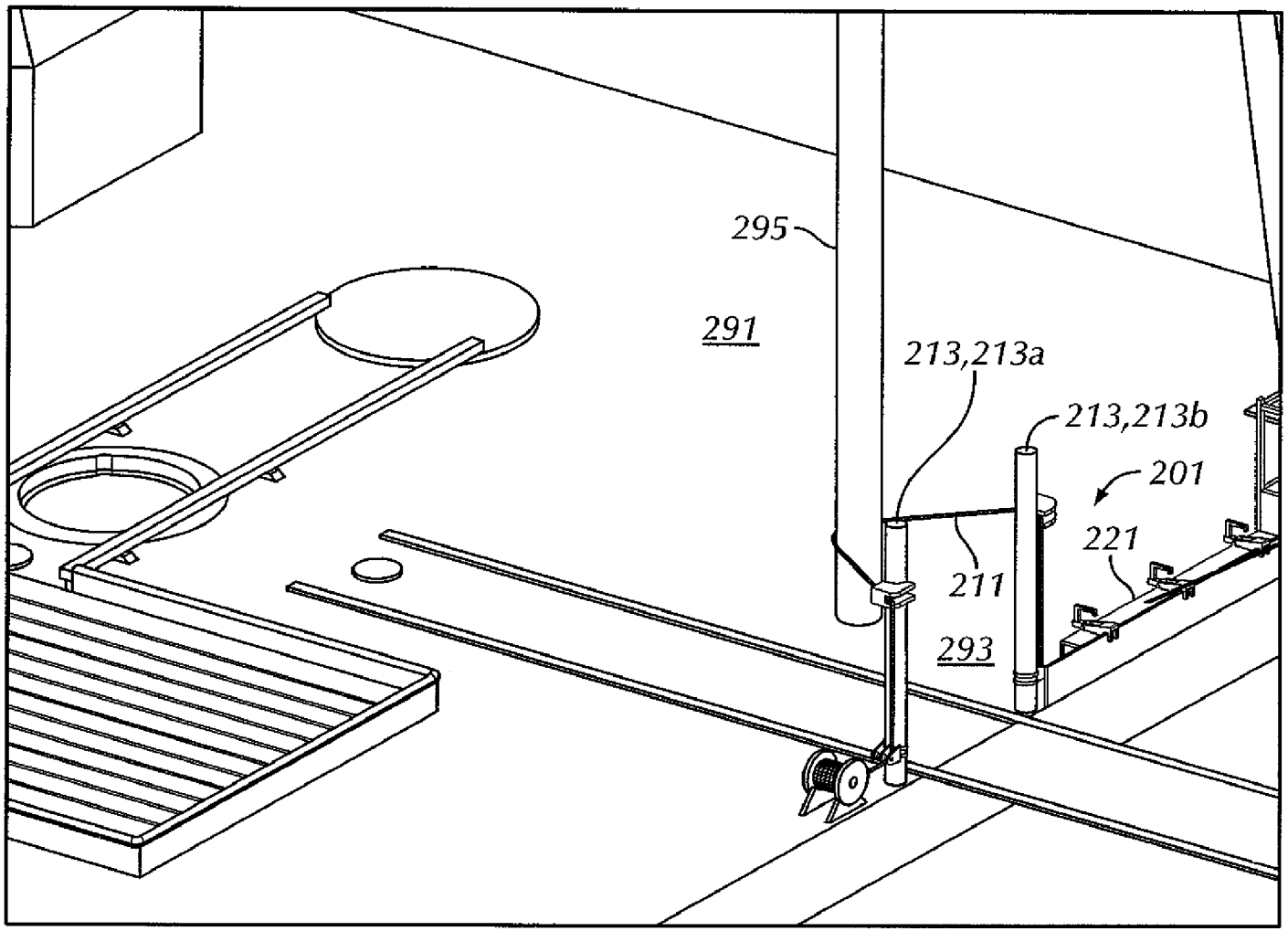
Figure 2D:
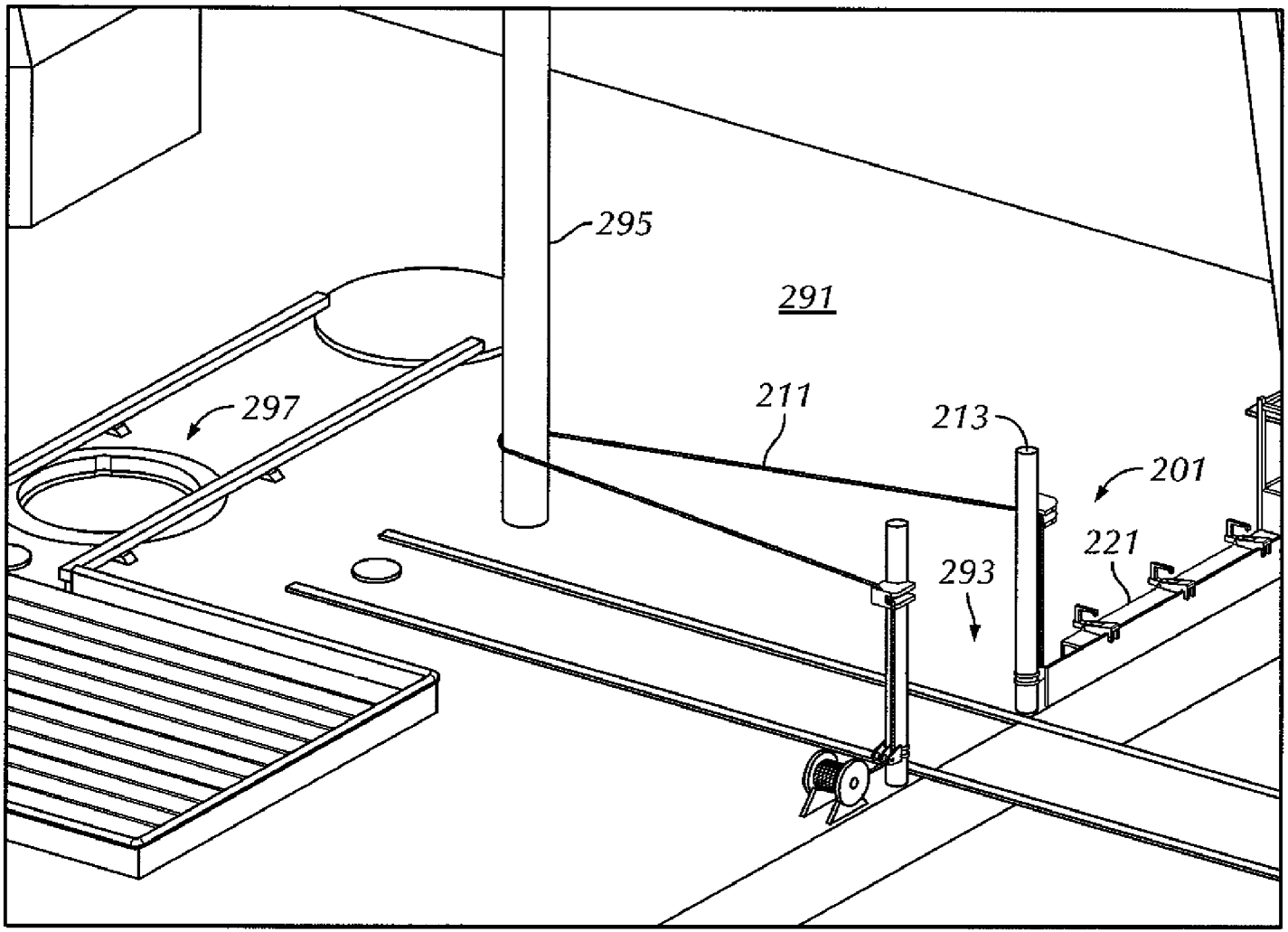

As tubular member 295 continues to be received within and be positioned further within drilling rig 291, such as by the elevator of drilling rig 291, contact member 211 of control apparatus 201 may continue to displace. As such, contact member 211 may be removed from tubular member 295 once tubular member 295 has been positioned at a desired location, such as once adjacent a downhole opening 297, and/or contact member 211 may be removed from tubular member 295 once tubular member 295 has reached a desired rate of movement (e.g., momentum and/or velocity). For example, as shown in FIG. 2D, contact member 211 may be removed from tubular member 295 after tubular member 295 has been positioned adjacent downhole opening 297. After removal from tubular member 295, contact member 211 and control mechanism 221 may be repositioned, such as to the original receiving position shown in FIG. 2A. As such, control apparatus 201 may be used to receive an additional tubular member 295 within drilling rig 291.

Figure 3A:
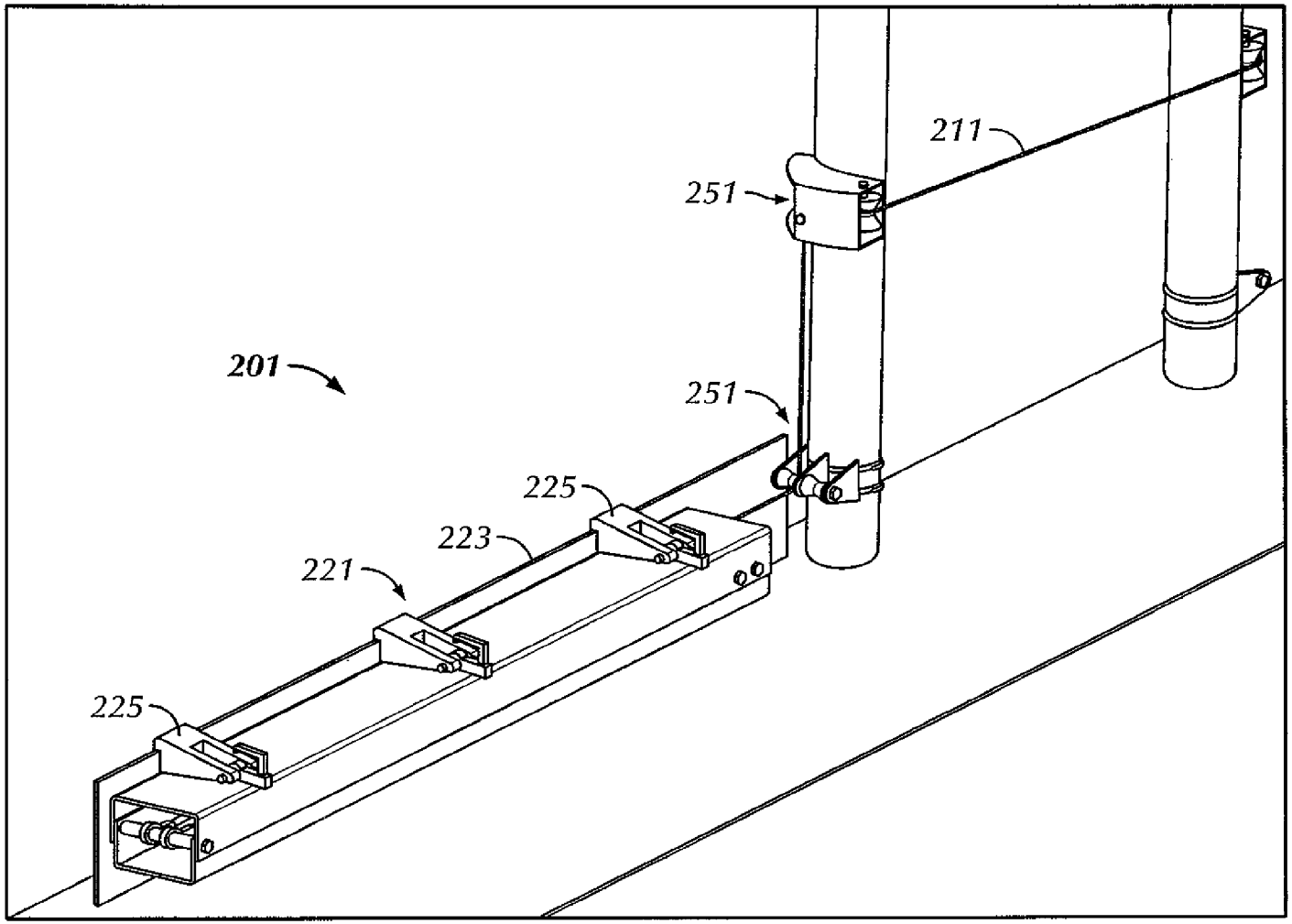
FIGS. 3A and 3B show multiple views of the control apparatus shown in FIGS. 2A-2D.
Figure 3B:
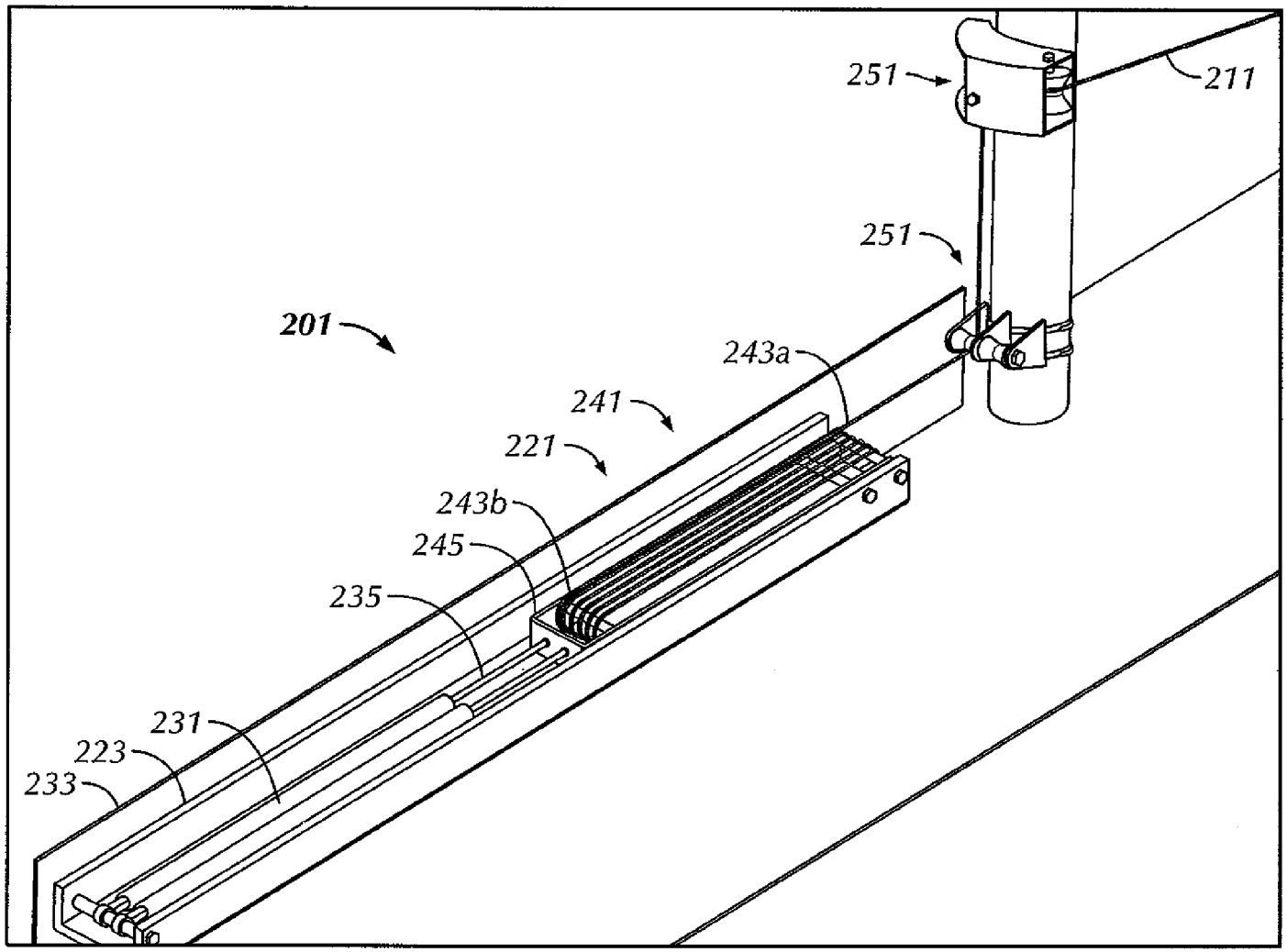

Referring now to FIGS. 3A and 3B, perspective views of control apparatus 201 shown in FIGS. 2A-2D in accordance with embodiments disclosed herein are shown. Specifically, in FIG. 3A, a perspective outside view of control apparatus 201 is shown, and in FIG. 3B, a perspective inside view of control apparatus 201 is shown. As discussed above, control apparatus 201 includes contact member 211 and control mechanism 221, in which control mechanism 221 and contact member 211 are operably coupled to each other. As such, in this embodiment, contact member 211 may be received within control mechanism 221. However, it should be understood that the present disclosure contemplates other methods to operably couple contact member 211 and control mechanism 221 (such as discussed below).

As shown, control mechanism 221 of control apparatus 201 may be disposed adjacent contact member 211, such as upon drilling rig 295. In such an embodiment, control mechanism 221 may be disposed upon and/or integrally formed with the floor and/or side panel of drilling rig 295. However, it should be understood that the present disclosure contemplates having other arrangements of control mechanism 221 and contact member 211, as long as control mechanism 221 and contact member 211 are operably coupled to each other. For example, in some embodiments, control mechanism 221 may need not be disposed upon or adjacent drilling rig 295, in which contact member 211 may be routed to control mechanism 221 off drilling rig 295 for operable coupling with control mechanism 221.

As discussed above, control mechanism 221 may be pneumatically actuated, hydraulically actuated, electrically actuated, and/or mechanically actuated to control contact member 211. In the embodiments shown in FIGS. 3A and 3B, control mechanism 221 is a pneumatically actuated control mechanism. As such, control mechanism 221 may include a housing 223, in which housing 223 is shown as disposed upon the floor of drilling rig 295. Further, to access the inside of control mechanism 221, the walls of housing 223 may be removably mounted thereon. Therefore, as shown in this embodiment, connectors 225 are disposed upon an upper surface of housing 223, in which connectors 225 may be used to remove one or more walls of housing 223 for interior access. FIG. 3B shows an interior perspective view then of control mechanism 221.

Disposed within control mechanism 221 is an actuator 231, in which actuator 231 is used to dampen movement and/or dissipate energy from a tubular member contacting contact member 211. Further, a pulley system 241 may be disposed within control mechanism 221, in which actuator 231 and pulley system 241 may be attached and/or coupled to each other. In this embodiment, pulley system 241 includes one or more pulleys 243A and 243B disposed at each end of pulley system 241. Specifically, in this embodiment, multiple pulleys 243A and 243B are disposed at each end of pulley system 241. However, it should be understood that the present disclosure contemplates having other structures for the pulley system, such as one pulley or multiple disposed at each end of the pulley system.

In this embodiment then, contact member 211 may be received within pulley system 241, in which contact member 211 may be disposed about and between pulleys 243A and 243B of pulley system 241. Pulleys 243A and 243B of pulley system 241 may be able to move with respect to each other, such as along the length of housing 223 of control mechanism 221. As the distance between pulleys 243A and 243B of pulley system 241 increases, the length of contact member 211 decreases. Similarly, as the distance between pulleys 243A and 243B of pulley system 241 decreases, the length of contact member 211 increases. As such, the distance between pulleys 243A and 243B of pulley system 241 may be controlled to control the length of contact member 211, particularly when tubular member 295 contacts and is received by contact member 211.

Referring still to FIGS. 3A and 3B, because control mechanism 221 may be pneumatically, hydraulically, electrically, and/or mechanically actuated (as mentioned above), control mechanism 221 may include one or more pneumatic or hydraulic cylinders 233 within actuator 231. In this embodiment, cylinders 233 may be coupled to pulley system 241, in cylinders 233 may be used to dampen movement and/or dissipate energy from pulley system 241. Specifically, cylinders 233 may have rods 235 extending therefrom and pistons disposed therein, in which rods 235 are coupled to pulleys 243B of pulley system 241. Rods 235 may be coupled to pulleys 243B, such as by having a cradle 245 disposed about pulleys 243B and rods 235 coupled thereto. Further, an end of cylinders 233 of actuator 231 may be attached to one end control mechanism 221, and pulleys 243A of pulley system 241 may be attached to another end of control mechanism 221.

As contact member 211 is received within and reciprocates in and out of control mechanism 221, the distance between pulleys 243A and 243B may move accordingly with respect to each other. As such, as the distance between pulleys 243A and 243B decreases, actuator 231 may increase in length, and as the distance between pulleys 243A and 243B increases, actuator 231 may decrease in length.

For example, as shown in FIGS. 2A-2D, as tubular member 295 contacts and is received by contact member 211, contact member 211 may increase in length to control the movement of tubular member 295. As contact member 211 increases in length, contact member 211, which is disposed about pulley system 241, may cause pulleys 243A and 243B to decrease in distance from each other. As pulleys 243A and 243B then decrease in distance from each other, actuator 231 may increase in length. As actuator 243 increases in length, actuator may provide a damper and/or dissipate energy from the movement of pulley system 241, thereby having a corresponding action on tubular member 295 received by contact member 211. A similar reverse process, or one substantially similar thereto, may be used then, such as when removing tubular members from drilling rig 295.

It should be understood that the present disclosure contemplates having other structures and/or arrangements for the control mechanism. For example, as mentioned above, in another embodiment, actuator may instead be hydraulically actuated, electrically actuated, and/or mechanically actuated, rather than only pneumatically actuated as shown in FIGS. 3A and 3B. As such, in another embodiment, the actuator may include a spring and/or elastic materials disposed therein to dampen movement and/or dissipate energy from a tubular member. Further, in another embodiment, the actuator may include an accumulator, such as a hydraulic accumulator, in which a receiver and/or one or more valves may be coupled to the accumulator to damper movement and/or dissipate energy from a tubular member.

In embodiments in which the actuator of the control mechanism includes a fluid disposed therein, such as a hydraulic or pneumatic actuator, a hose may be used to transport the fluids of the actuator. With an actuator having a fluid disposed therein, one or more speed control valves may be coupled to the actuator. As such, the speed control valve may control, at least partially, the speed and/or movement of the contact member, particularly when the contact member contacts the tubular member. One having ordinary skill in the art will appreciate that with a pneumatic actuator, as gas and/or air is received therein, the internal pressure may accumulate therein. As such, as this internal pressure accumulates within the actuator, this may increase the force required to move the contact member of the control apparatus.

Further, one or more brackets 251 may be used within control apparatus 201 to facilitate the orientation and/or movement of contact member 211. As shown in FIGS. 2A-2D, 3A, and 3B, two brackets 251 may be disposed adjacent to access opening 293 of drilling rig 291, in which contact member 211 may be disposed through brackets 251. Specifically, one bracket 251 may be used to dispose contact member 211 across access opening 293, and the other bracket 251 may be used to align contact member 211 with control mechanism 221 to operably couple contact member 211 with control mechanism 221.

Figure 4:
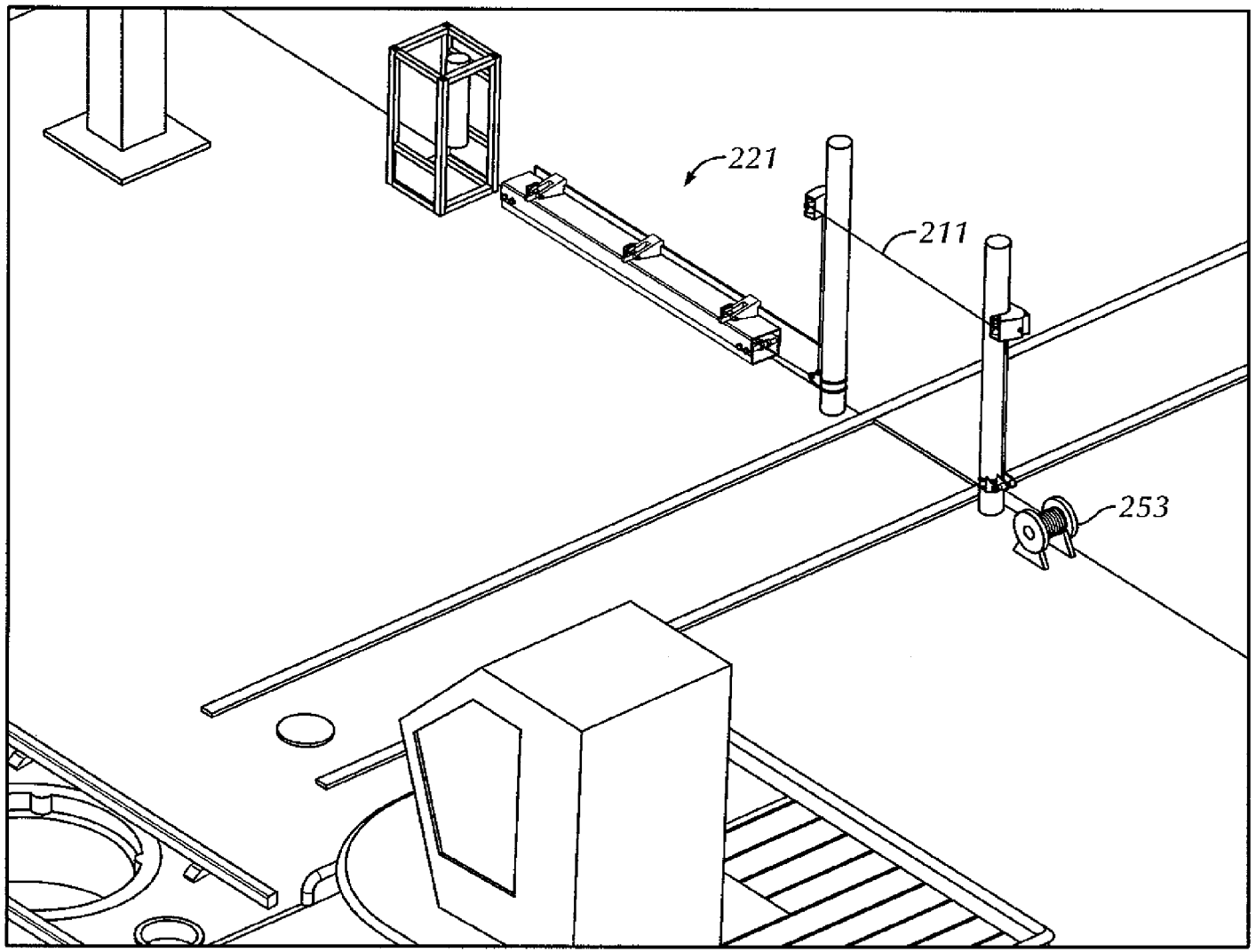
FIG. 4 shows a perspective view of a control apparatus in accordance with an embodiment of the present disclosure.

Furthermore, in some embodiments, another actuator may be incorporated with control apparatus 201 to re-position contact member 211 after use with a tubular member 295. For example, as shown in FIG. 4, a winch 253 may be operably coupled to contact member 211, such as having contact member 211 received within winch 253. Specifically, the end of contact member 211 opposite control mechanism 221 may be received within winch 253, in which winch 253 may be used to retract contact member 211 after use with a tubular member. As such, the actuator used to re-position the contact member may automatically operate after use, or a mechanism, such as a check mechanism, may be incorporated into the control apparatus to prevent automatic operation and/or retraction. For example, by using a check mechanism, after contact member 211 has been retracted after used with tubular member 295, the check mechanism may engage, such as to hold contact member 211 in position. Then, once desired and after tubular member 295 has been removed from contact member 211, the check mechanism may be disengaged, such as by an operator, to enable contact member 211 to re-position to receive another tubular member.

Figure 5:
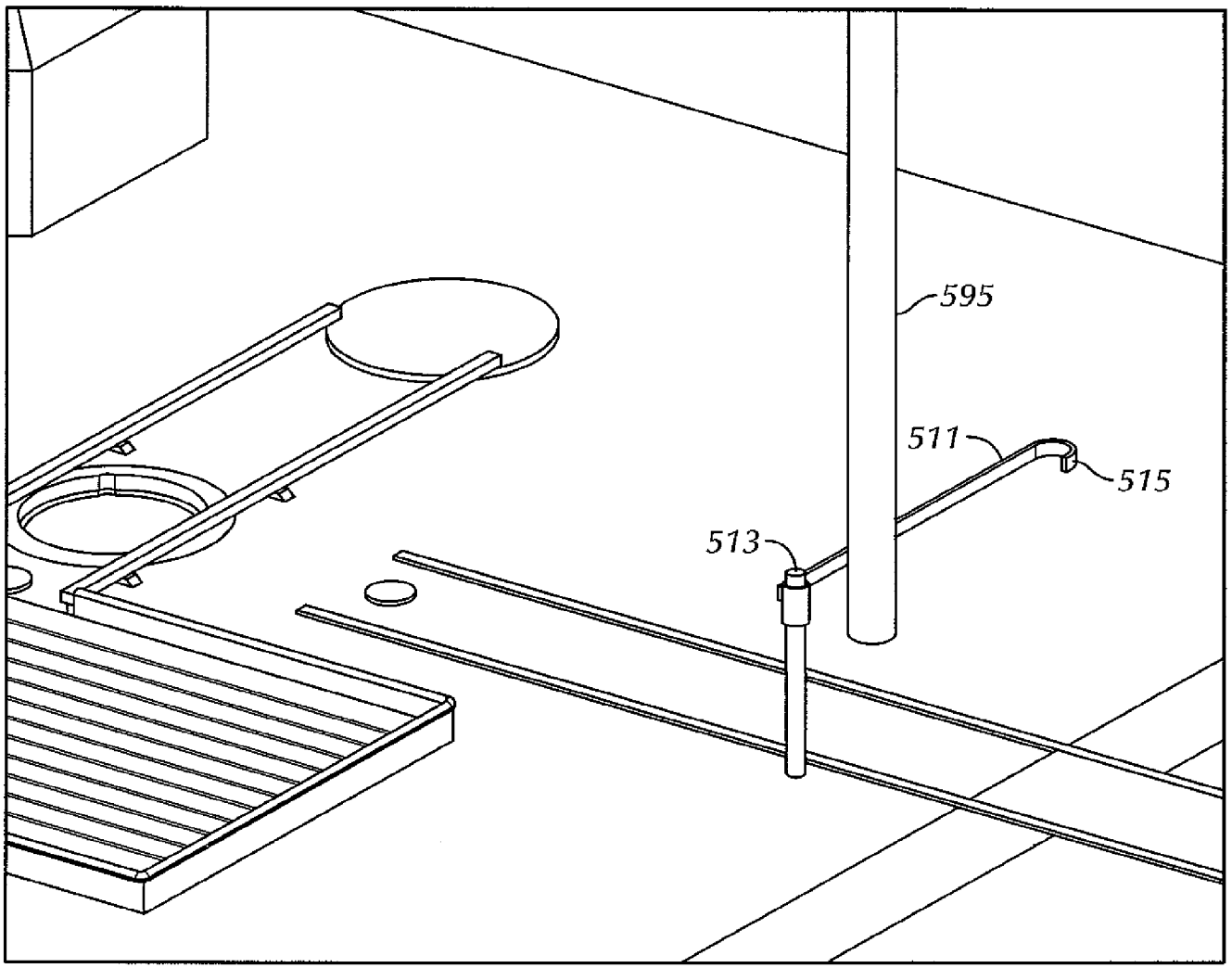
FIG. 5 shows a perspective view of a control apparatus in accordance with an embodiment of the present disclosure.

As mentioned above, the contact member of the control apparatus may be flexible and/or rigid. As such, referring now to FIG. 5, a perspective view of control apparatus 501 in accordance with embodiments of the present disclosure is shown. In this embodiment, contact member 511 of control apparatus 501 is formed as a rigid member. Specifically, in this embodiment, contact member 511 may be formed as an arm member, in which the arm member is formed from a rigid material. Further, the arm member may include a receiving section 515, in which receiving section 515 may be formed as an arcuate section having an arc formed therein. Receiving section 515 is shown disposed at an end of contact member 511 and may be formed such as to receive tubular member 595. As tubular member 595 contacts and is received by contact member 511, contact member 511 may be able to rotate. Specifically, contact member 511 may be attached to and/or disposed upon frame 513, in which contact member 511 may be able to rotate with respect to frame 513. As tubular member 595 contacts and is received by contact member 511, contact member 511 may rotate about frame 513. Tubular member 595 may then move along the length of contact member 511 during rotation to be received within receiving section 515. However, it should be understood that the present disclosure contemplates having an arm member with other structures, such as an arm member without a receiving section.

In this embodiment, a control mechanism (not shown), operably coupled to contact member 511, may be attached to an end of contact member 511, such as between or about frame 513. Further, in another embodiment, the control mechanism may be disposed within frame 513. Further, in yet another embodiment, the control mechanism may be disposed adjacent to contact member 511, in which the control mechanism may still be operably coupled to contact member 511 (such as by a cable or arm). As such, it should be understood that the present disclosure contemplates having multiple structures and arrangements to incorporate an arm member within a control apparatus.

Figure 6:
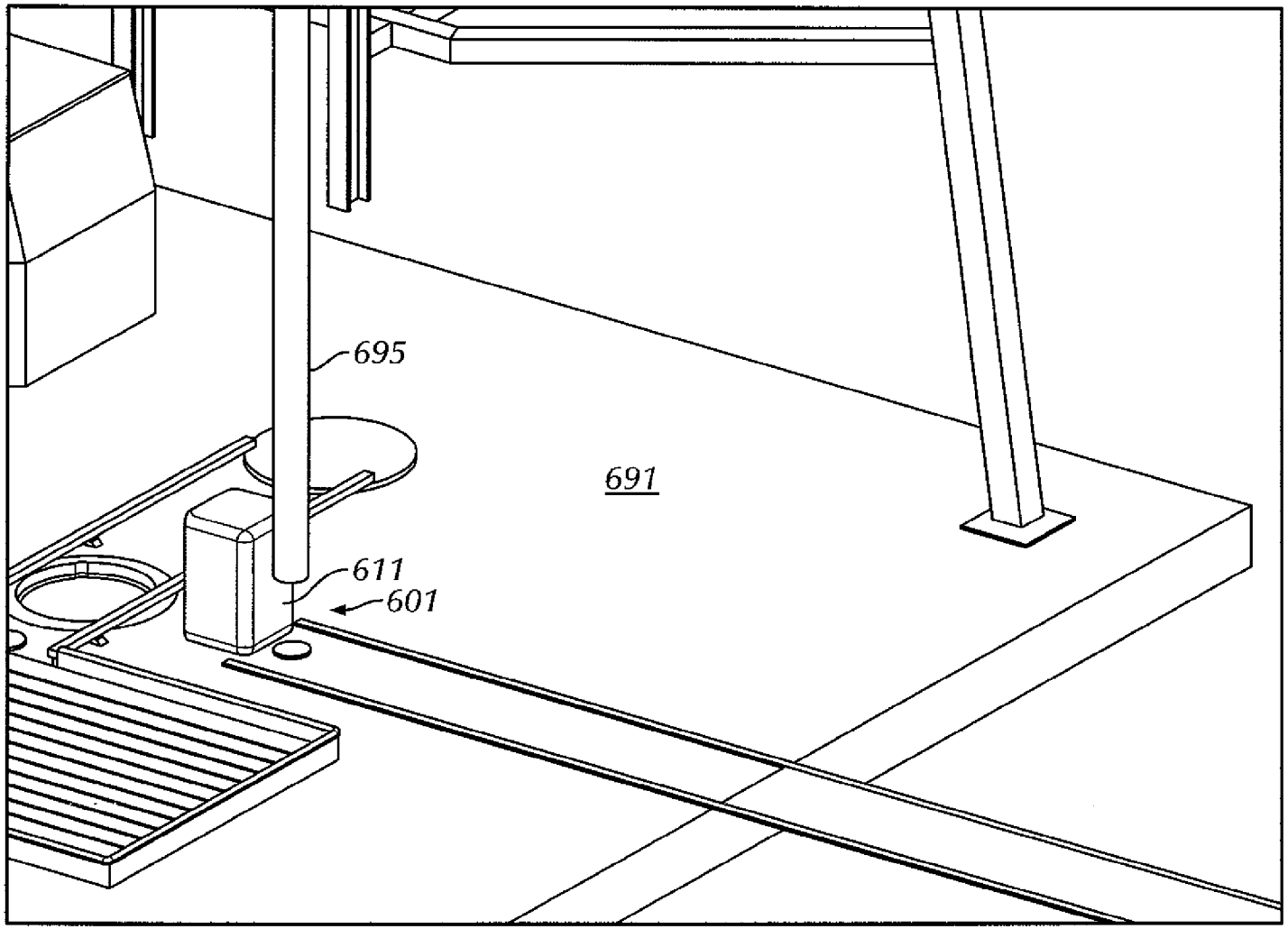
FIG. 6 shows a perspective view of a control apparatus in accordance with an embodiment of the present disclosure.

Referring now to FIG. 6, a perspective view of a control apparatus 601 in accordance with embodiments of the present disclosure is shown. In FIG. 6, control apparatus 601 includes a contact member 611, in which contact member 611 may be inflatable, or at least partially inflatable. A control mechanism, e.g., air pump (not shown), may be operably coupled to contact member 611 to inflate and/or deflate contact member 611 as desired. In one embodiment, the control mechanism may be disposed within contact member 611. Further, in another embodiment, the control mechanism may be disposed adjacent to contact member 611, or the control mechanism may be disposed off-site from drilling rig 691. As such, the control mechanism may be operably coupled to contact member 611 for operation, such as by having the control mechanism fluidly connected to contact member 611. By having the control mechanism fluidly connected to contact member 611, the control mechanism may provide inflatable fluid to and receive inflatable fluid from contact member 611. As such, any fluid known in the art may be used to inflate contact member 611; however, preferably a gas fluid that may be disposed into the atmosphere is used.

During use, a tubular member 695 received within drilling rig 691 may contact and/or be received by control apparatus 601. Specifically, tubular member 695 may engage contact member 611 of control apparatus 601, in which contact member 611 may selectively inflate and/or deflate to control tubular member 695. For example, before tubular member 695 is received within drilling rig 691, contact member 611 may be inflated, at least partially, with the control mechanism. Then, as tubular member 695 is received within drilling rig 691 and makes contact with contact member 611, contact member 611 may deflate, at least partially, to dampen movement and/or dissipate energy from tubular member 695. When deflating contact member 611, the control mechanism may be used to deflate contact member 611 and/or contact member 611 may be vented (e.g., such as venting to the atmosphere) for deflation. As such, control apparatus 601 may limit the movement of tubular member 695 within drilling rig 691, such as when assembling tubular member 695 within drilling rig 691.

Figure 7:
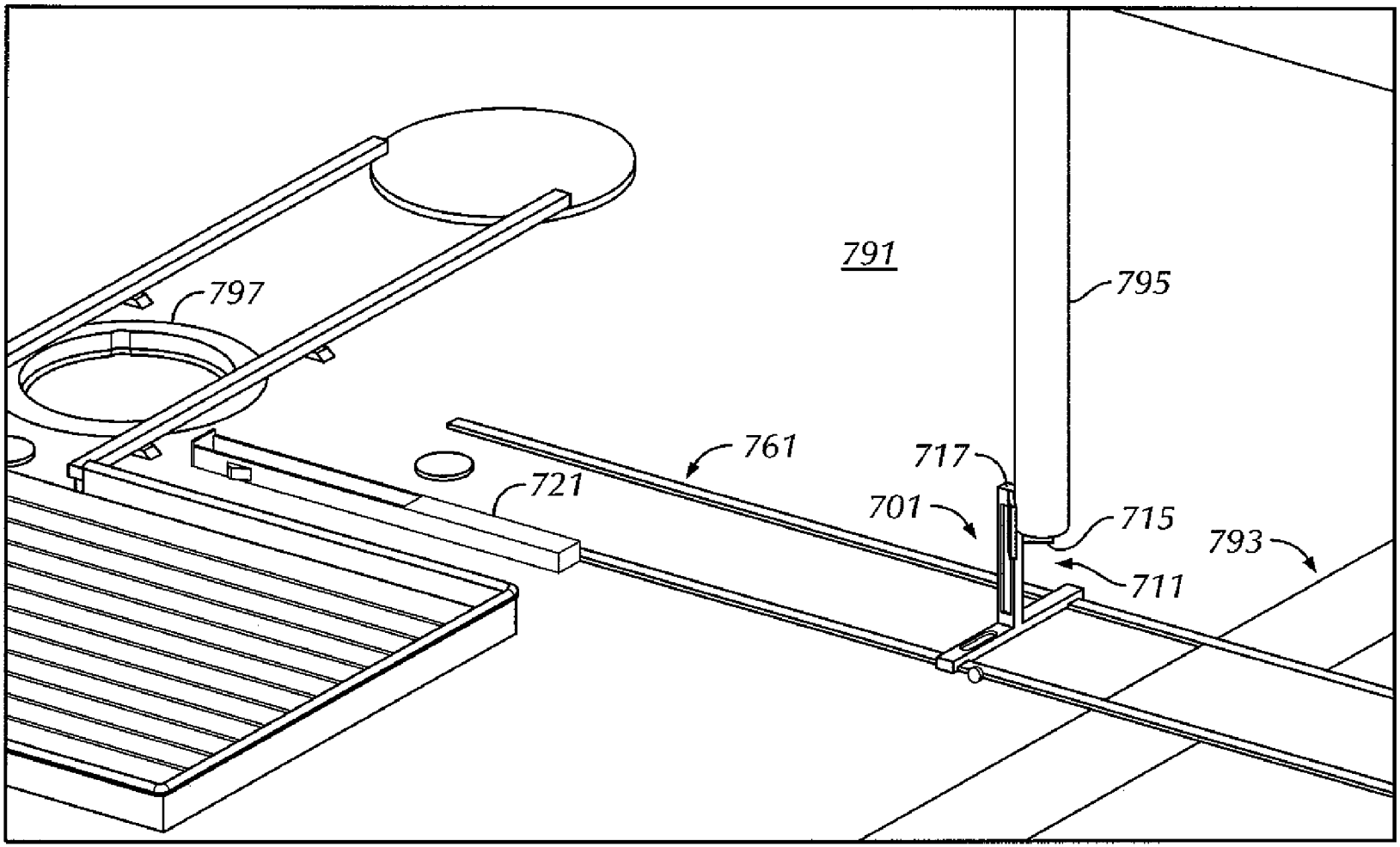
FIG. 7 shows a perspective view of a control apparatus in accordance with an embodiment of the present disclosure.

Referring now to FIG. 7, a perspective view of a control apparatus 701 in accordance with embodiments of the present disclosed is shown. In this embodiment, control apparatus 701 includes a contact member 711, in which contact member 711 may be movably disposed upon drilling rig 791. Specifically, in this embodiment, contact member 711 may be disposed upon a track assembly (which may include rails) 761, in which track assembly 761 may guide contact member 711 along a path, or at least partially, between an access opening 793 and a downhole opening 797. Furthermore, while track assembly 761 is shown "proud" of rig floor 791, it should be understood by those having ordinary skill that track assembly 761 (as well as tracks and/or rails of other embodiments) may be mounted flush with drilling rig floor 791. Furthermore, it should be understood that track assembly (including contact member 711) of the embodiment shown in FIG. 7 (as well as other embodiments) may be configured to extend up from drilling rig floor 791 when needed and retract back into drilling rig floor 791 when not needed.

As shown, contact member 711 may include an arm portion 717 with a receiving portion 715 attached thereto. For example, as shown in this embodiment, receiving portion 715 may be formed as an arcuate portion, in which the arcuate portion may have an arced shape so as to be able to receive tubular member 795 therein. It should also be understood that the present disclosure contemplates having multiple structures for the receiving portion without departing from the present disclosure. For example, in one embodiment, the receiving portion may also be formed having a V-shape, L-shape, or U-shape, in which the V/L/J-shaped receiving portion may be able to receive the tubular member. Further, in another embodiment, the receiving portion may be formed. Receiving portion 715 may then be movably attached upon arm portion 717. As such, receiving portion 715 may be able to move laterally upon arm portion 717 with respect to drilling rig 791.

Further, control apparatus 701 includes a control mechanism 721, in which contact member 711 is operably coupled to control mechanism 721. Control mechanism 721 may then be used to move contact member 711 along track assembly 761 and/or be used to move receiving portion 715 of contact member 711. In this embodiment, control mechanism 721 may be disposed upon the floor of drilling rig 791, in which the control mechanism 721 may operably couple to contact member 711, such as by using a flexible and/or rigid contact member. Further, in another embodiment, control mechanism 721 may be disposed within contact member 711, such as within the frame of contact member 711. Further, in yet another embodiment, control mechanism 721 need not be disposed on drilling rig 791, only as control mechanism 721 is operably coupled to contact member 611 for use.

Referring now to FIGS. 8A-8E, multiple perspective views of a control apparatus 801 in accordance with embodiments of the present disclosure are shown. In this embodiment, control apparatus 801 includes a contact member 811 and a control mechanism 821, in which contact member 811 and control mechanism 821 are operably coupled to each other. As shown, contact member 811 may include an arm member 817 with one or more receiving portions 815 attached thereto. As shown, receiving portions 815 may be formed as arcuate portions, in which the arcuate portions may have an arced shape so as to be able to receive tubular member 895 therein. For example, receiving portions 815 may include vacuum ports along their arcuate portions to enable contact member 811 to retain tubular member 895 through suctions. For example, devices similar to (and including) the "Elite Vacuum Pipe Lifter" marketed by Schoenbeck Plant and Machine Techniques of Nienstaedt Germany may be used for receiving portions 815. However, as discussed above, it should also be understood that the present disclosure contemplates having multiple structures, including, but not limited to tongs, clamps, and grips, for the receiving portion without departing from the present disclosure.

Further, receiving portions 815 may be movably attached upon arm portion 817. In this embodiment, receiving portions 815 may be able to move laterally along arm portion 817. Furthermore, receiving portions 815 may be able to rotate, at least partially, with respect to arm portion 817. For example, as shown in FIGS. 8A-8E, receiving portions 815 may be able to rotate to grasp tubular member 895, particularly when tubular member 895 is disposed adjacent control apparatus 801 and/or is contacting contact member 811. One or more sensors may also be operably coupled to contact member 811 to determine if tubular member 895 is contacting contact member 811.

Contact member 811 may be able to move both laterally and/or horizontally with respect to the drilling rig. In this embodiment, control member 811 is rotatably attached to control mechanism 821, and control mechanism 821 may be able to pivot with respect to the drilling rig. Further, control mechanism 821 may be disposed upon a track assembly 861, in which track assembly 861 may guide control apparatus 801 along a path, or at least partially, between an access opening and a downhole opening 897 of the drilling rig. As such, this enables contact member 811 to move both laterally and horizontally with respect to the drilling rig. Control mechanism 821 may then include actuators 831, such as pneumatic actuators and/or any other actuators known in the art, to enable movement of control mechanism 821 and contact member 811.

Figure 8A:
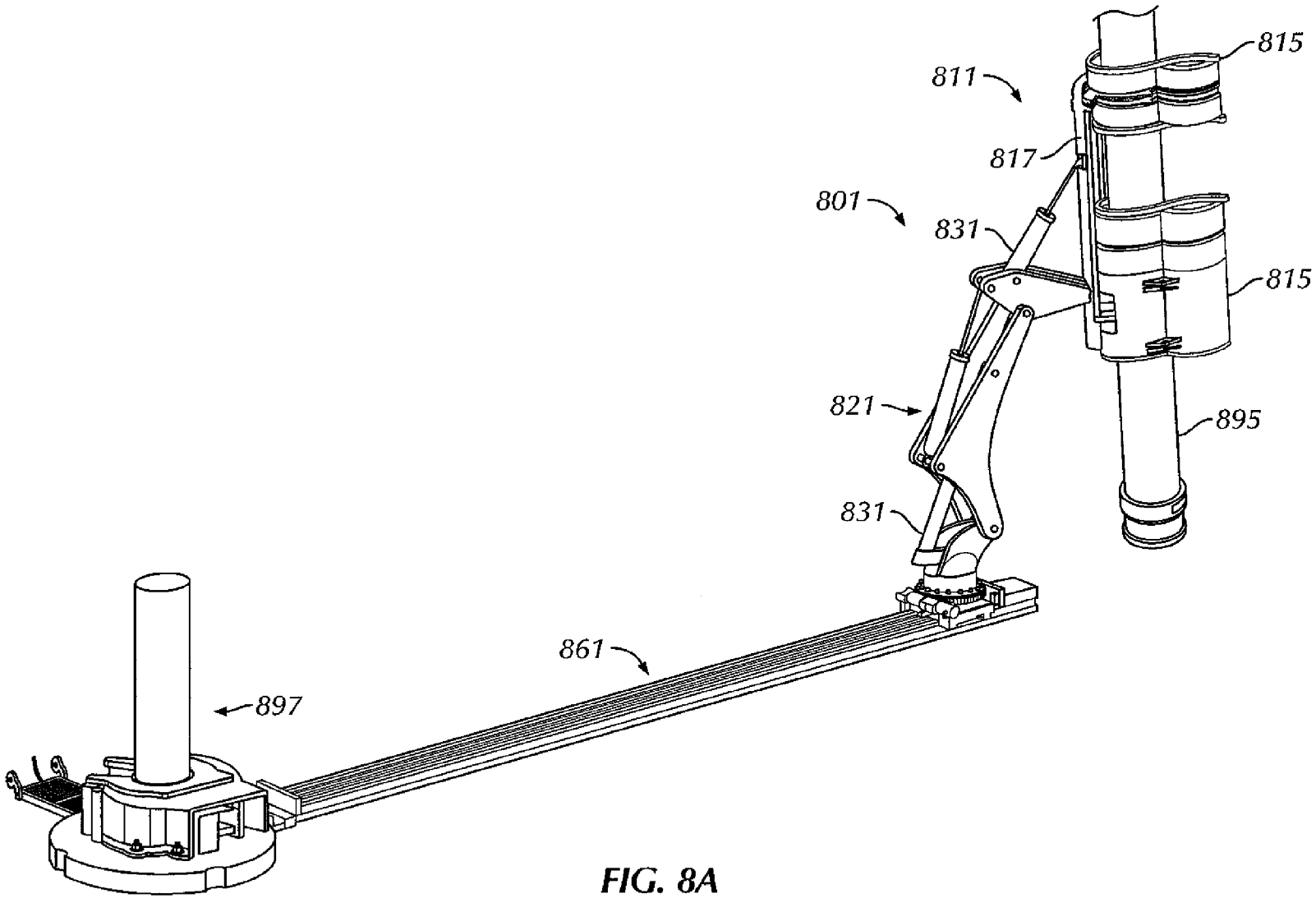
FIGS. 8A-8E show multiple views of a control apparatus in accordance with an embodiment of the present disclosure.
Figure 8B:
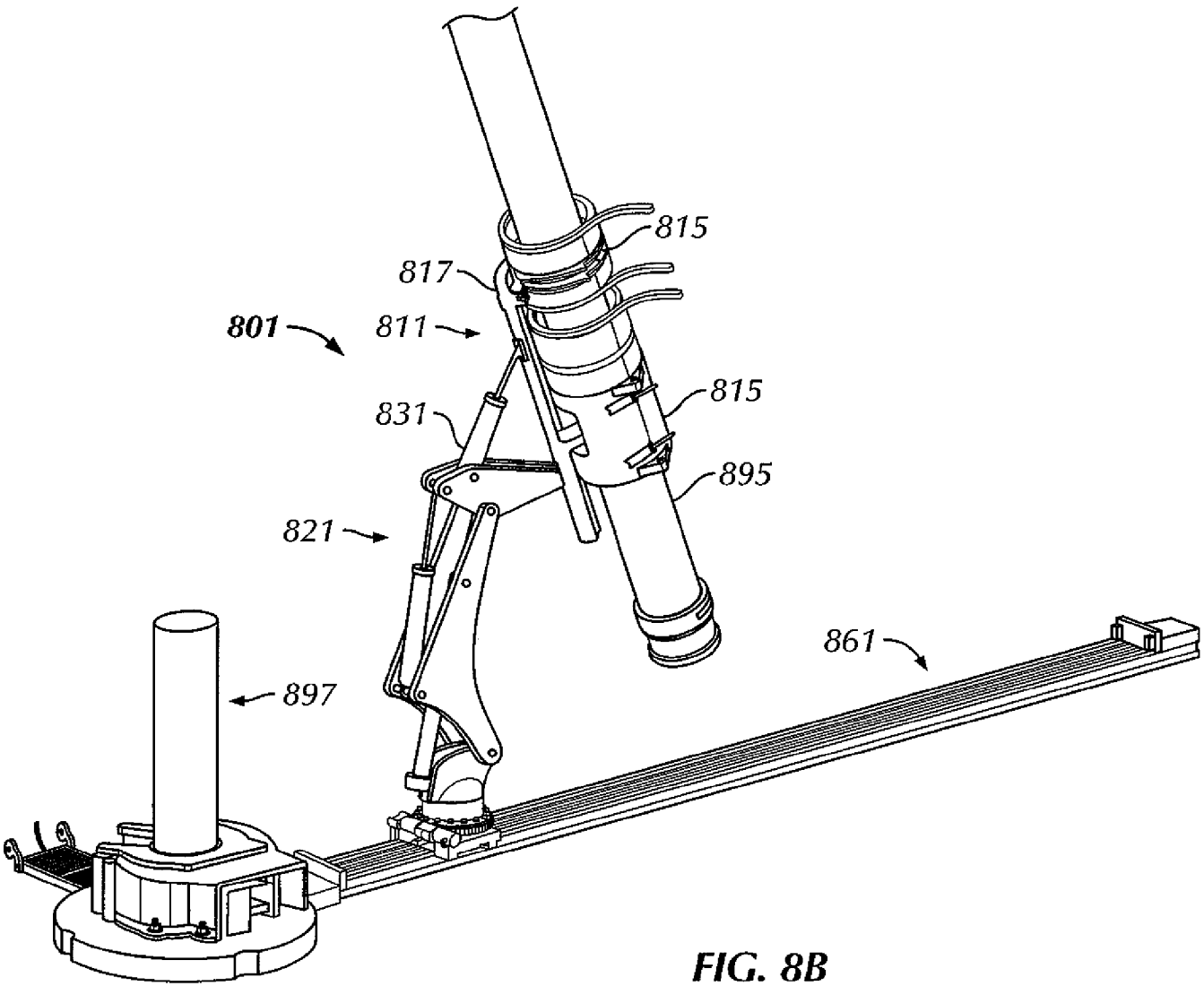
Figure 8C:
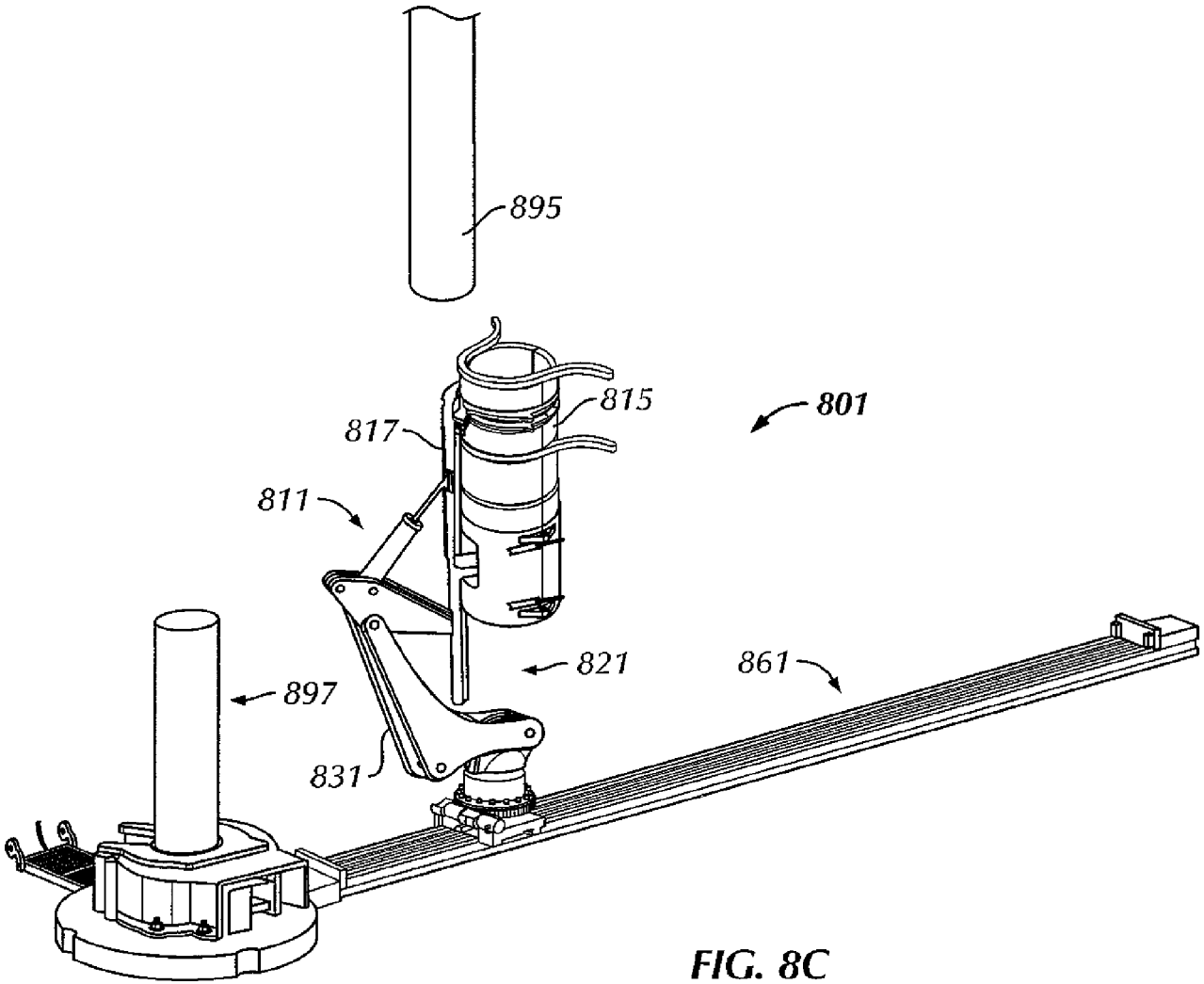

Referring still to FIGS. 8A-8E, FIG. 8A shows tubular member 895 being received within the drilling rig and contacting contact member 811. After tubular member 895 contacts contact member 811, contact member 811 may then be moved to grip tubular member 895, such as shown in FIG. 8B. Control mechanism 821 may move control apparatus 801 along track assembly 861 towards downhole opening 897. Once control apparatus 801 is adjacent to downhole opening 897, tubular member 895 may or may not disengage from control apparatus 801, such as by having the elevator of the drilling rig raise tubular member 895 from control apparatus 801. In FIGS. 8A-8E, tubular member 895 is shown as disengaging from control apparatus 801 once adjacent to downhole opening 897. However, in other embodiments, tubular member 895 may stay engaged with control apparatus 801 once adjacent to downhole opening 897. For example, when control apparatus 801 rotates adjacent to downhole opening 897, tubular member 895 may stay engaged with control apparatus 801. Control apparatus 801 may then be used to guide tubular member 895, such as guide tubular member 895 upon the downhole drill string disposed within downhole opening 897.

Figure 8D:
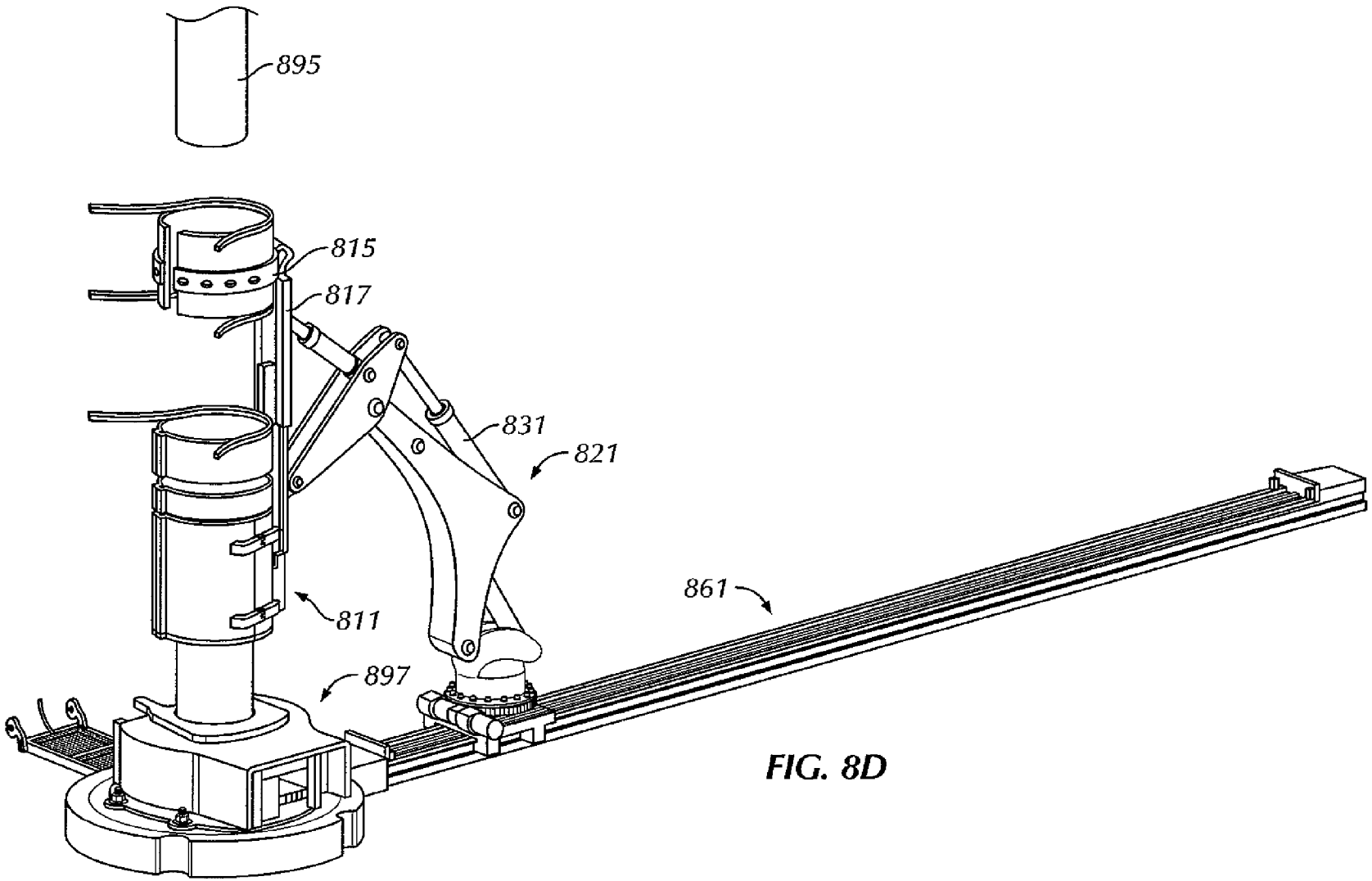
Figure 8E:
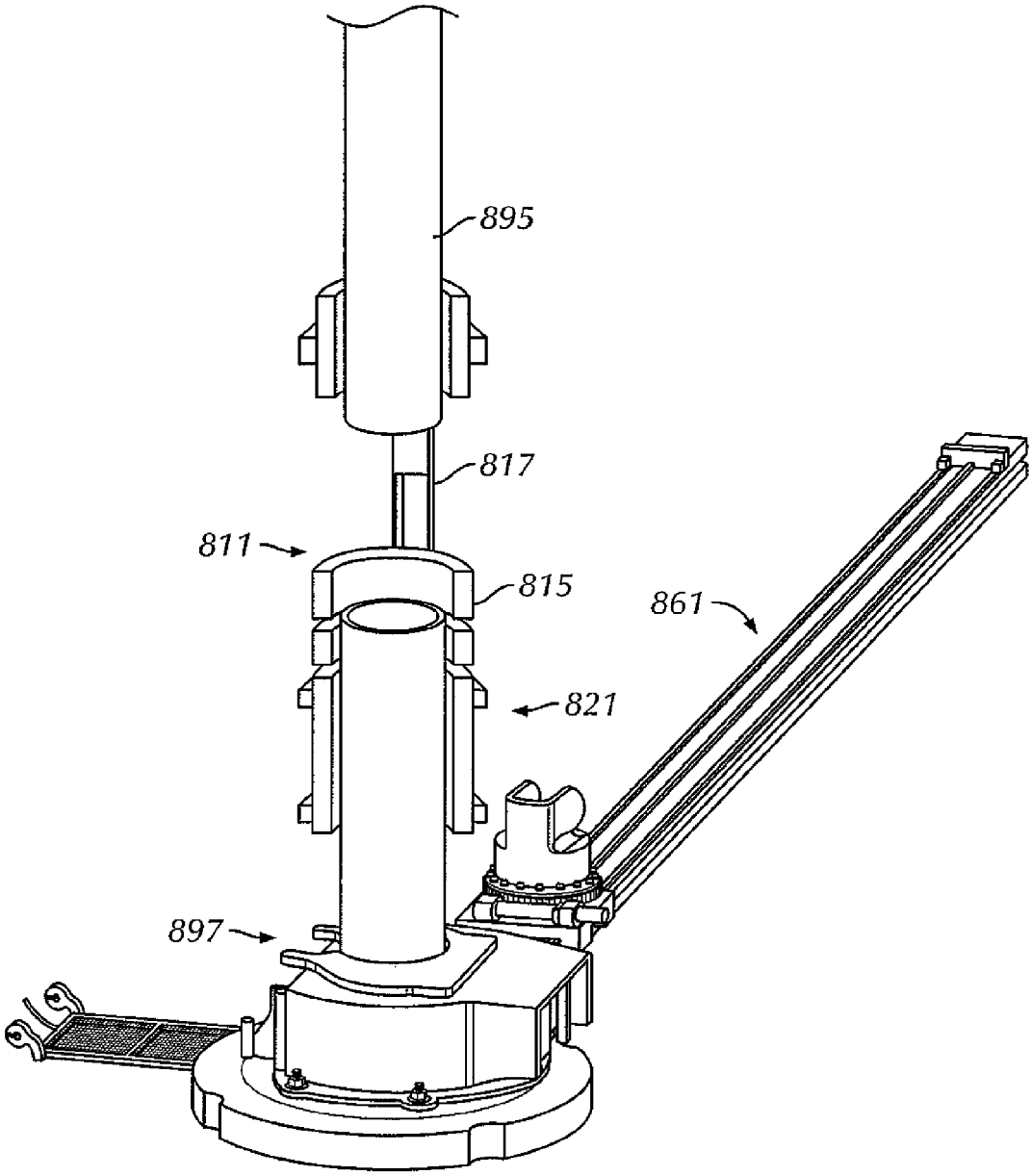

Further, as shown specifically in FIGS. 8D and 8E, control apparatus 801 may be able to assist during make-up of multiple tubular members 895. For example, in reference to FIG. 5C, after tubular member 895 is disengaged from control apparatus 801, control apparatus 801 may move adjacent and above downhole opening 897. Tubular member 895 may then be disposed within control apparatus 801, such as by having the elevator lower tubular member 895 into contact member 811. Further, receiving sections 815 may rotate to open and close to grasp tubular member 895, such as when tubular member 895 is lowered into control apparatus 801. As such, with control apparatus 801 disposed adjacent to downhole opening 897, control apparatus 801 may be used to assist and/or guide tubular member 895 upon the downhole drill string. Further, control apparatus 801 may also be used to assist during make-up of tubular member 895 with the downhole drill string, such as supporting the drill string and/or tubular member 895, or control apparatus 801 may be used similarly to power tongs to rotate tubular member 895.

Figure 9A:
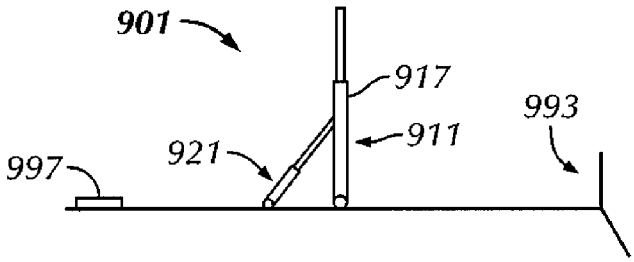
FIGS. 9A-9E show multiple views of a control apparatus in accordance with an embodiment of the present disclosure.
Figure 9B:
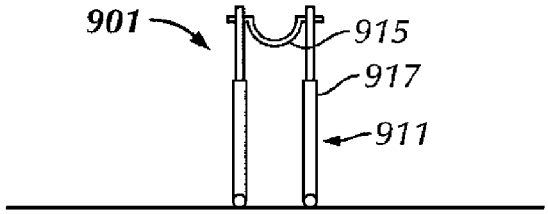
Figure 9E:
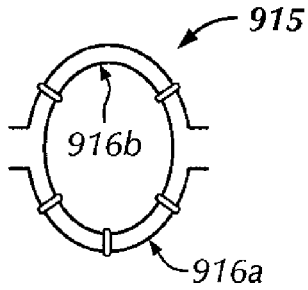
Figure 9C:
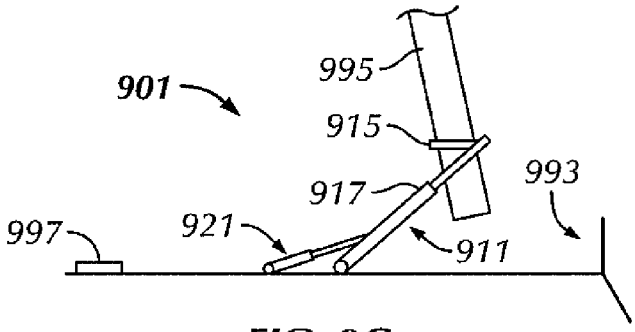
Figure 9D:
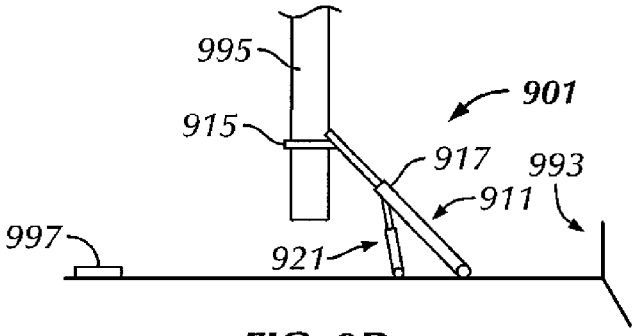

Referring now to FIGS. 9A-9E, multiple perspective views of a control apparatus 901 in accordance with embodiments of the present disclosure are shown. FIG. 9A shows a side view of control apparatus 901, and FIG. 9B shows a front view of control apparatus 901. FIGS. 9C and 9D show side views of control apparatus 901 when in use. In this embodiment, control apparatus 901 includes a contact member 911 and a control mechanism 921, in which contact member 911 and control mechanism 921 are operably coupled to each other. Further, contact member 911 and/or control mechanism 921 may be pivotally attached to the drilling rig. In this embodiment, both contact member 911 and control mechanism 921 are pivotally attached to the drilling rig. Additionally, contact member 911 and/or control mechanism 921 of control apparatus 901 may be movably attached to the drilling rig. In such an embodiment, control apparatus 901 may be able to move about the drilling rig, such as move along the floor of the drilling rig between an access opening 993 and a downhole opening 997.

As shown, contact member 911 may include one or more arm portions 917 with a receiving portion 915 attached thereto. For example, as shown in this embodiment, contact member 911 includes two arm portions 917, in which receiving portion 915 may be pivotally attached therebetween. As such, receiving portion 915 may be able to pivot and/or rotate between arm portions 917. Further, contact member 911 may include a damper, a spring, and/or elastic materials attached thereto and/or disposed therein to dampen movement and/or dissipate energy from a tubular member 995, particularly when a tubular member 995 is received by receiving member 915. For example, receiving portion 915 may include an elastic material therein to dissipate energy from the movement of a tubular member. In another embodiment, a damper may be provided between receiving portion 915 and one or more arm portions 917 of contact member, in which the damper may dampen the movement of a tubular member. Furthermore, contact member 911 may be horizontally adjustable with respect to the drilling rig. For example, one or more arm portions 917 may be horizontally adjustable, in which receiving portion 915, attached thereto, is able to move along with arm portions 917. Contact member 911 may be adjusted horizontally as desired, such as by using an actuator, when receiving a tubular member 995.

Referring still to FIGS. 9A-9E, contact member 911 and control mechanism 921 are operably coupled to each other, in which control mechanism 921 may be attached to contact member 911. Specifically, in this embodiment, control mechanism 921 may be pivotally attached to contact member 911. As such, control mechanism 921 may include actuators, such as attached thereto or disposed therein, in which control mechanism 921 may be used to dampen movement and/or dissipate energy from a tubular member 995 received thereby. The actuators of control mechanism 921 may then be pneumatically, hydraulically, electrically, and/or mechanically actuated (as mentioned above), or any other actuators known in the art, when included within control apparatus 901. Additionally or alternatively, control mechanism 921 may include a biasing mechanism (e.g., a spring and/or elastomeric material), in which the biasing mechanism may be used to dampen movement and/or dissipate energy from a tubular member 995.

Referring now specifically to FIGS. 9C and 9D, FIG. 9C shows a view of control apparatus 901 in a first position, and FIG. 9D shows a view of control apparatus 901 in a second position. As discussed above, a control apparatus in accordance with the present disclosure may be used to facilitate the movement of tubular members as being received within a drilling rig, in addition to facilitating the movement of tubular members as departing from a downhole opening and leaving the drilling rig. As such, when receiving a tubular member 995 within a drilling rig, tubular member 995 may enter through access opening 993, be received by control apparatus 901, and control apparatus 901 may move from a first position (shown in FIG. 9C) to a second position (shown in FIG. 9D). Control apparatus 901 may then release tubular member 995 when adjacent to downhole opening 997. Similarly, when a tubular member 995 is exiting the drilling rig, tubular member 995 may be extracted from downhole opening 997, be received by control apparatus 901, and control apparatus 901 may move from the second position (shown in FIG. 9D) to the first position (shown in FIG. 9C). Tubular member 995 may then be released or disengage from control apparatus 901 when adjacent to access opening 993.

Further, as shown in FIG. 9B, receiving portion 915 of contact member 911 may have a U-shape. However, and as discussed above, it should also be understood that the present disclosure contemplates having multiple structures for the receiving portion without departing from the present disclosure. As such, in another embodiment, receiving portion 915 may have a substantially circular or oval shape, as shown in FIG. 9E. Further, receiving portion 915 may have rotating sections 916 formed therein, in which tubular member 995 may be selectively move through rotating sections 916 to be received by receiving portion 915. For example, rotating sections 916 may be configured to rotate in one direction and/or rotate in multiple directions. As such, through the configuration of rotating sections 916, receiving portion 915 may selectively receive and/or dispatch of tubular members when in use with control apparatus 901. Further, as shown, receiving portion 915 may have multiple rotating sections 916A, and/or receiving portion may have one rotating section 916B.

As shown in the above embodiments, the contact member and the control mechanism of the present disclosure may take one of multiple forms and/or arrangements. As such, the present disclosure contemplates having other arrangements and structures without departing from the scope of the present disclosure. For example, one or more of the contact members as disclosed above may be combined. In another embodiment, a contact member may incorporate both an inflatable member and an receiving portion, such as by having the inflatable member disposed upon the receiving portion.

Further, as described and as would be understood by those having ordinary skill, contact members of the control mechanisms disclosed herein may engage or receive tubular members in a variety of mechanisms and may dissipate the (kinetic) energy of the moving tubular member in a variety of ways. For example, contact members may alternatively "rigidly engage" or "dampen" the tubular member following contact. For "rigid" systems, the transition of the tubular member from moving to stopped may approximate an instantaneous change in speed. Alternatively, the "dampened" mechanisms may induce a "rate" or "time delayed" transition such that the tubular members transfer from moving objects to stopped objects over a greater period of time than the "rigid" systems.

Embodiments disclosed herein may provide for one or more of the following advantages. First, embodiments disclosed herein may provide for a control apparatus that may increase efficiency of a drilling rig. For example, when a tubular member engages a control apparatus of the present disclosure, the control apparatus may quickly and efficiently control the tubular member upon entering a drilling rig. Furthermore, it should be understood by those having ordinary skill that the present disclosure shall not be limited to specific examples depicted in the Figures and described in the specification. As such, various mechanisms to help control a tubular member in an oilfield drilling rig may be used without departing from the scope of the present disclosure. While the present disclosure has been described with respect to a limited number of embodiments, those skilled in the art, having benefit of this disclosure, will appreciate that other embodiments may be devised which do not depart from the scope of the disclosure as described herein. Accordingly, the scope of the invention should be limited only by the attached claims.

What is claimed is:

1. A control apparatus to receive a tubular member, comprising:

a contact member configured to engage the tubular member; and a control mechanism operably coupled to the contact member;

wherein the control mechanism is configured to dampen movement of at least one of the tubular member and the contact member as the tubular member engages the contact member;

wherein the contact member comprises a tether member, the tether member comprising at least one of a wire, a cable, a rope, a line, a lead, and a chain;

wherein the control mechanism comprises a pulley system; and wherein the contact member is disposed at least partially about the pulley system.

2. The control apparatus of claim 1, wherein at least a portion of the contact member is flexible.

3. The control apparatus of claim 2 wherein the contact member is disposed across an access opening adjacent a drilling rig.

4. The control apparatus of claim 2, wherein an end of the contact member is disposed within a rig floor.

5. The control apparatus of claim 1, wherein the control mechanism is at least one of pneumatically actuated, hydraulically actuated, electrically actuated, and mechanically actuated.

6. The control apparatus of claim 5, wherein the control mechanism comprises a cylinder with a piston disposed therein, wherein the piston is slidably received within the cylinder.

7. The control apparatus of claim 1, wherein the control mechanism is at least one of pneumatically actuated, hydraulically actuated, electrically actuated, and mechanically dampened.

8. The control apparatus of claim 1, wherein the contact member comprises at least one of a protective material and a dampening material disposed thereon.

9. The control apparatus of claim 1, wherein the pulley system comprises at least a first pulley and a second pulley with the contact member at least partially disposed about the first pulley and the second pulley of the pulley system.

* * * * *